US005363569A

United States Patent [19]

Kadakia

[11] Patent Number: 5,363,569

[45] Date of Patent: * Nov. 15, 1994

[54] BEARING AND SEAL ASSEMBLY FOR CLOTHES DRYER DRUM

[75] Inventor: Pratish R. Kadakia, Fort Dodge, Iowa

[73] Assignee: White Consolidated Industries, Inc., Cleveland, Ohio

[ * ] Notice: The portion of the term of this patent subsequent to Jun. 8, 2010 has been disclaimed.

[21] Appl. No.: 29,879

[22] Filed: Mar. 11, 1993

[51] Int. Cl.[5] ..... F26B 11/04

[52] U.S. Cl. ..... 34/601; 34/603; 34/242

[58] Field of Search ..... 34/133 F, 133 R, 133 H, 34/242, 243 R, 133 G, 133 J

[56] References Cited

U.S. PATENT DOCUMENTS

| | | | |
|---|---|---|---|
| 2,886,901 | 5/1959 | Whyte et al. | 34/133 F |
| 3,033,623 | 5/1962 | Thomson | 308/238 |
| 3,399,464 | 9/1968 | Erickson et al. | 34/133 |
| 3,570,138 | 3/1971 | Douglas et al. | 34/133 F |
| 3,875,686 | 4/1975 | Smoot | 34/133 F |
| 4,430,809 | 2/1984 | Jackson et al. | 34/133 |
| 5,216,823 | 6/1993 | Ripley | 34/133 F |

*Primary Examiner*—Denise L. Gromada
*Attorney, Agent, or Firm*—Pearne, Gordon, McCoy & Granger

[57] ABSTRACT

A bearing and seal assembly for rotatably supporting an open front end of a clothes dryer drum includes a ring of felt-like material positioned between the circular open front end of the drum and a circular support flange of smaller diameter coaxially nested within the end of the drum. The felt-like material is fixed to the flange and substantially fills an annular space between the drum and the flange to preclude air leakage therebetween. The upper or outer surface of the felt seal, which is in engagement with the circular open front end of the drum, is powder coated with a wear-resistant material such as polytetrafluoroethylene. The powder-coated surface is slidably engaged by the drum and bears the weight of the end of the drum. The felt-like material acts as a sound dampener and shock absorber between the rotating drum and the fixed flange to preclude transmission or generation of undesirable noise caused by rotation of the drum.

15 Claims, 3 Drawing Sheets

BEARING AND SEAL ASSEMBLY FOR CLOTHES DRYER DRUM

BACKGROUND OF THE INVENTION

1. Field of the Invention

The present invention generally relates to bearing structures and, more particularly, to bearing and seal assemblies for rotatably mounting and supporting an open end of a clothes dryer drum.

2. Description of the Related Art

A typical clothes dryer of the domestic type includes a box-like cabinet which houses a horizontally rotatable clothes-containing drum. The cabinet includes a door to permit user-access to the drum via its open front end.

Generally, two methods have been used to rotatably support the open front end of the dryer drum. The first method employs roller-type supports beneath the drum, while the second method provides a bearing and seal assembly, typically in contact with the inner periphery of the front end of the drum. The bearing and seal assembly is located between the drum and a circular flange provided by a front panel of the cabinet to rotatably and sealably support the drum.

With reference to U.S. Pat. No. 3,399,464, the disclosure of which is expressly incorporated herein by reference, a ring-like bearing and seal assembly for rotatably supporting the front end of a dryer drum is shown. The bearing and seal assembly includes a pair of plastic bearing pads that are fixed to an upper portion of a circular support flange extending inwardly from the front panel of the dryer cabinet. The circular flange surrounds the access opening provided by the front panel of the cabinet. The front end of the drum provides a circular lip that rides on and bears against the two noted bearing pads, the circular support flange being coaxially nested within the open front end of the drum. The annular space between the drum lip and the support flange that is not occupied by the pair of bearing pads is filled with lengths of felt material constituting a seal for minimizing air leakage between the lip and the flange.

A more recently developed bearing and seal assembly, which comprises separate felt and split-ring bearings, is disclosed in U.S. Pat. No. 4,430,809. The felt bearing is mounted to a support ring inwardly adjacent the access opening in the front of the dryer and constitutes an air seal. The split ring bearing, which is made of a wear resistant material such as polytetrafluoroethylene (hereafter PTFE) or nylon, is mounted to the dryer drum via a series of resilient tab-like fasteners. The inner periphery of the split-ring bearing rides against the outer surface of the felt bearing.

Another bearing and seal assembly is disclosed in the commonly assigned U.S. patent application Ser. No. 07/852,574, the disclosure of which is expressly incorporated herein in its entirety. In this assembly, the bearing and seal is comprised of a ring of felt-like material having an upper portion of relatively dense felt and a lower portion of relatively less dense felt. The upper portion includes wear-resistant glide members or bearing pads upon which bears the weight of the rotatable drum.

While bearing and seal assemblies of the above-described types may adequately provide rotatable support for the front end of the dryer drum, undesirable noise transmission to the dryer cabinet can occur via the bearing pads or bearing ring due to a rotating non-concentric dryer drum. Also, plastic or wear resistant material, such as nylon or PTFE, used to form the bearing ring or pads is relatively expensive and, thus, increases the cost of the resulting product.

Therefore, there exists a need in the art for a bearing and seal assembly which reduces or eliminates the transmission and generation of noise, and which does so at a reduced cost.

SUMMARY OF THE INVENTION

In accordance with the invention, a ring of felt material is fixed to an inwardly extending circular flange provided by the front panel of a dryer cabinet. The upper arcuate surface of the felt ring is powder-coated with a wear resistant material such as PTFE. A circular lip at the open front end of the dryer drum slidably engages the powder-coated surface. The circular flange is coaxially nested within the circular lip of the drum to rotatably support the drum.

In further accordance with the present invention, most of the felt ring, which also provides an air seal between the drum and the circular flange, is made of relatively low density, low cost felt material. The remaining portion of the felt ring provides the upper arcuate powder-coated surface which is slidably engaged by the drum and is formed of higher density felt material to resist compaction due to the weight of the rotating drum bearing thereupon. The higher density felt material also acts as a shock absorbing element between the rotating drum and the circular flange which underlies the felt ring, thereby minimizing the generation and transmission of noise.

The use of felt material having an integral PTFE powder-coated surface simultaneously provides an effective air seal between the drum and cabinet, and eliminates the noise transmission and generation problems associated with separate or additional bearing pads, while reducing material, production, and labor costs.

BRIEF DESCRIPTION OF THE DRAWINGS

A fuller understanding of the invention may be had by referring to the following description and claims, taken in conjunction with the accompanying drawings, wherein:

DETAILED DESCRIPTION OF THE PREFERRED EMBODIMENT

Figure 1:
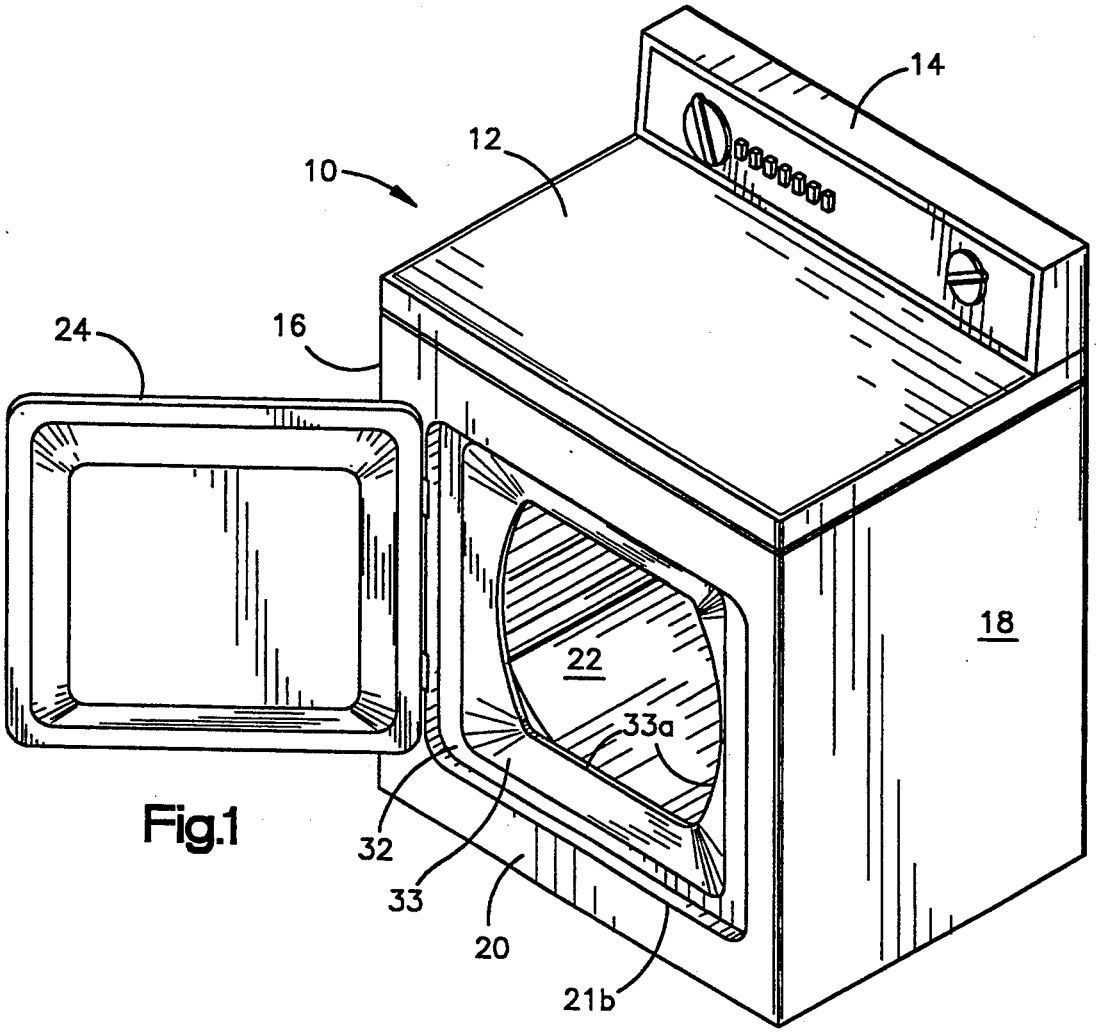
FIG. 1 is a front perspective view of a domestic clothes dryer in an open door condition.

With reference to FIG. 1, a clothes dryer 10 of the domestic type which incorporates the present invention is illustrated. The clothes dryer 10 has a box-like cabinet formed from painted sheet metal, as is well known in the art. The dryer 10 includes a horizontal top panel 12 with a control console 14 extending along its rear edge. The control console allows the user to regulate the operation of the clothes dryer 10 to provide drying of clothes placed within the dryer in a predetermined manner. The dryer 10 further includes a pair of vertical side panels 16 and 18, and a vertical rear panel (not shown).

A vertical front panel 20 provides an access opening 22 which is normally closed by a door 24 that is hinged along its left edge, as shown, for movement about a vertical axis. When the door 24 is open as shown in FIG. 1, a user can reach through the access opening 22 and into the interior of the clothes dryer 10 to insert clothing therein or remove clothing therefrom.

Figure 2:
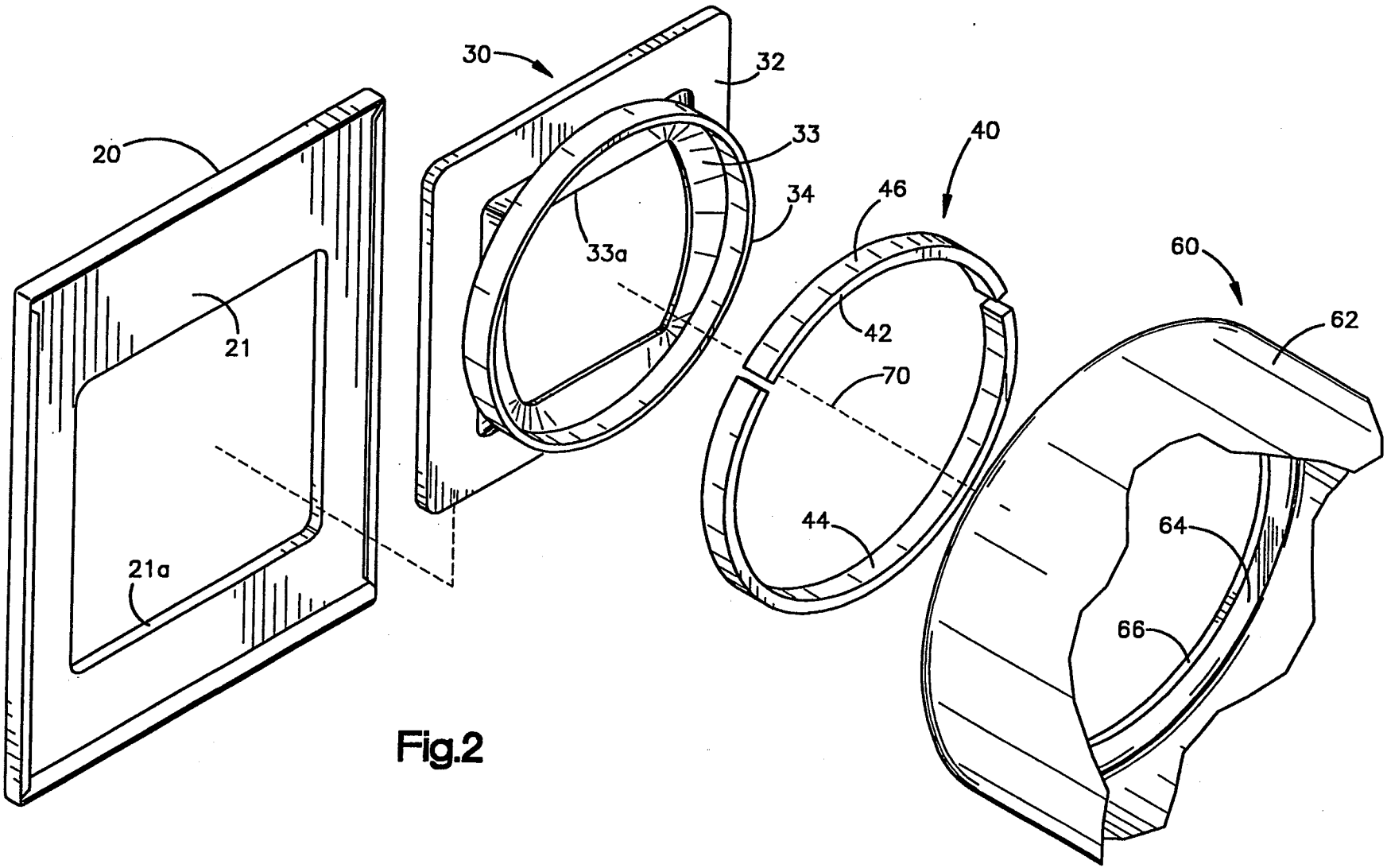
FIG. 2 is a rear exploded perspective view of a front portion of the clothes dryer of FIG. 1 which includes a bearing and seal assembly in accordance with the present invention; and, FIG. 3 is a side elevational view, in cross section, of the bearing and seal assembly of the present invention, with portions cut away.

Turning to FIG. 2 of the drawings, the clothes dryer discussed with regard to FIG. 1 can be seen to include, in addition to the front panel 20, a drum support panel 30, a bearing and seal assembly 40 in accordance with the present invention, and a dryer drum 60 that, in operation, rotates on a horizontal axis 70.

The front panel 20 provides an inner surface 21 having an inner periphery 21*a* which defines, in part, the access opening 22 (see FIG. 1). The front panel 20 also provides a seat against which the door 24 seals during operation of the dryer 10. A conventional switch (not shown) is provided adjacent the front panel to preclude operation of the dryer without closure of the door 24 against the front panel 20.

The drum support panel 30 has a generally planar, plate-like front portion 32 that is fixed by suitable mechanical means to the inner surface 21 of the front panel 20. Centrally located in the plate-like front portion 32 is an aperture constituting, in part, the access opening 22 (FIG. 1). With further reference to FIG. 2, the drum support panel 30 includes, in addition to the plate-like front portion 32, a transition ring 33 that is generally annular in shape with a circular outer periphery and a generally rectangular inner periphery 33*a*, as illustrated.

The transition ring 33 has extending horizontally from its outer circular periphery a circular drum support flange 34 which is inwardly spaced from the plate-like front portion 32. The transition ring 33 extends inwardly from the plate-like portion 32 to support the circular drum support flange 34 at a relatively inwardly displaced position. When assembled, by welding or suitable mechanical fastening means, the front panel 20 and the drum support panel 30, including its elements 32, 33, and 34, are fixed in position relative to each other and constitute a unitary structure.

The bearing and seal assembly 40, in accordance with the invention, rotatably supports the front end 62 of the dryer drum 60, the rear end (not shown) of the drum 60 being supported by conventional means. The assembly 40 preferably includes an upper felt member 42 of a high density felt material and a lower felt member 44 of a relatively lower density felt material.

The high density material comprising the upper felt member 42 helps to prevent compression or compaction of the felt member due to the load or weight of the front end 62 of the dryer drum 60. The lower felt member 44 is formed from relatively lower density material because it does not support the load of the dryer drum 60 and, hence, is not susceptible to similar compressive forces.

Figure 3:
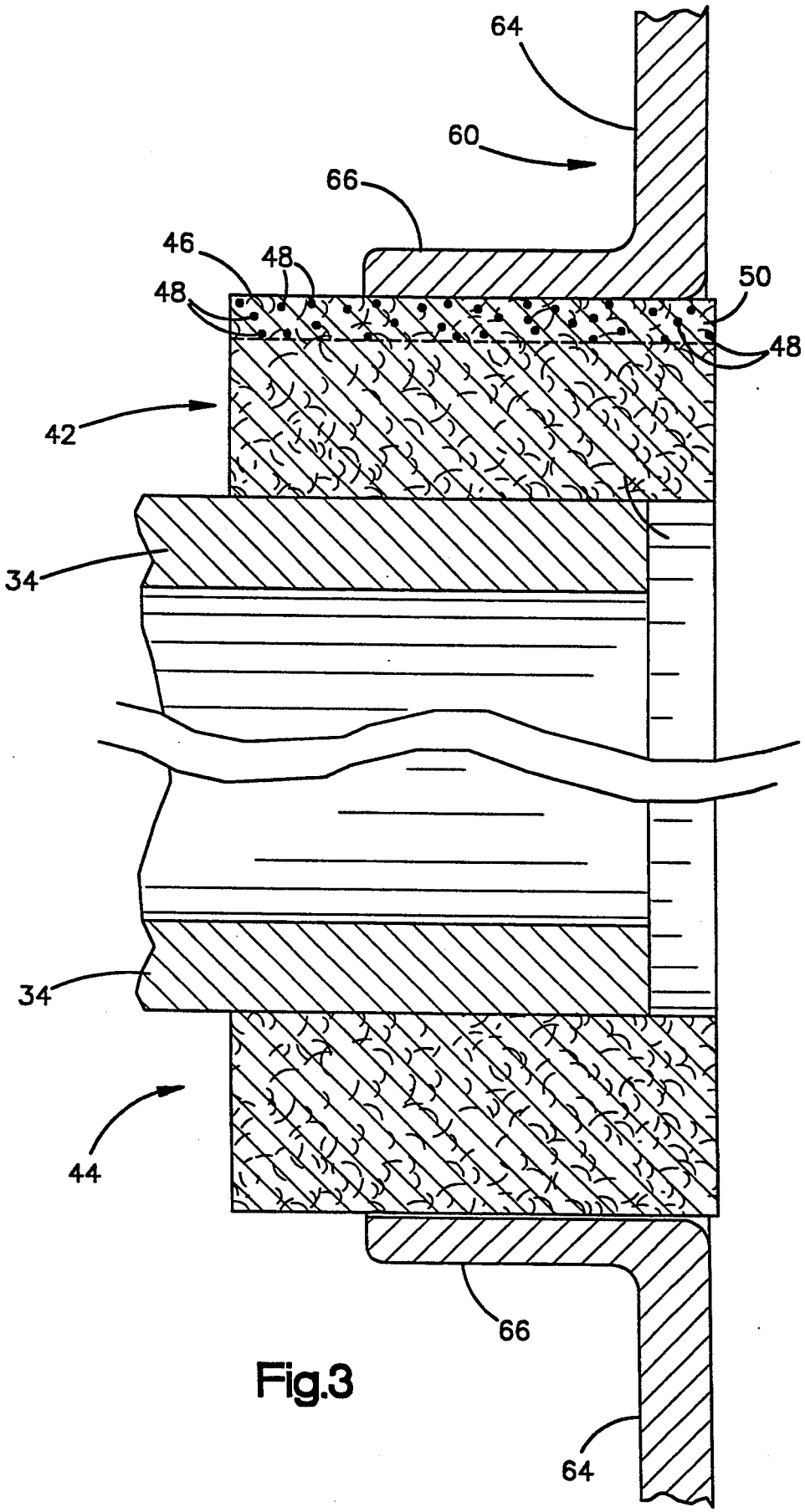

As can be seen best in FIGS. 2 and 3, the front end 62 of the dryer drum 60 includes an annular front wall 64. The annular front wall 64 provides, at its inner periphery, a horizontally extending circular or annular lip 66 that generally surrounds the bearing and seal assembly 40 and the support flange 34. The annular lip 66 rides or bears upon, and is vertically supported by, the outer or upper surface 46 of the upper felt member 42.

The felt members 42 and 44 combine to provide a generally continuous ring of felt-like material that is fixed to the exterior of the circular flange 34 by, for example, a suitable adhesive material or mechanical fastening means. Alternatively, the upper and lower felt members 42 and 44 can be attached or adhered to an integral elastic ring which, in turn, is elastically mounted or fit over the annular flange 34.

It can be seen that the upper felt member 42 constitutes approximately 25% of the circumferential extent of the ring of felt-like material while the lower felt member 44 constitutes approximately 75% thereof. The combination of high density and low density felt material in this manner provides a relatively low cost drum support and air seal, as the amount of high density felt, which is relatively more expensive than the low density felt, is reduced. Naturally, if product expense is no consideration, the entire ring could be formed of a high density material. The upper felt member 42 has deposited upon its upper or outer surface 46 a powder coating of wear resistant material such as PTFE, the powder being identified by reference numeral 48 in FIG. 3.

According to the method currently employed and contemplated by applicant to manufacture the high density felt member 42, the PTFE powder 48 is applied to the upper or outer surface 46 of the high density felt member 42 in a continuous fashion. The powder 48, which preferably has a particle size of between about 1.5 and 4 microns with a bulk density of about 475 to 550 grams/liter and a specific gravity of about 2.2, is preferably applied at a rate of about 8.7 to 10.0 grams per square yard. After being deposited on the surface of the upper felt member 42, the PTFE powder 48 is mechanically rubbed or worked into the interstices of the upper felt member 42 to create a zone 50 of PTFE powder impregnated felt. As shown best in FIG. 3, the zone 50 of PTFE powder impregnation, which is delimited from the remainder of the felt material by a dashed line, extends downwardly a short distance from the outer or upper surface 46 of the upper felt member 42.

With continued reference to FIG. 3, wherein the drum 60 with its associated circular lip 66, the felt members 42 and 44, and the circular flange 34 are shown in their normal positions when the dryer drum is rotating, it can be seen that the smaller diameter circular flange 34 is coaxially nested within the larger diameter circular lip 66 of the drum 60. The annular space between the flange 34 and the lip 66 is substantially filled by the felt-like material constituted by felt members 42 and 44 so as to establish an air seal therebetween. The PTFE powder-coated upper surface 46 of the upper felt member 42 is adjacent to and supports the drum 60 and, more specifically, is in engagement with the circular lip 66.

It has been found that, as the drum 60 rotates and bears upon the powder-coated surface 46 of the upper felt member 42, an amount of PTFE is transferred to the circular lip 66 of the drum 60 and forms a thin PTFE layer or coating thereon. Applying the powder 48 to the upper surface 46 of the high density upper felt member 42 significantly reduces friction produced by engagement of the drum 60 with the upper felt member 42 during operation of the clothes dryer drum, while providing an effective and inexpensive air seal. Also, rotational engagement of the powder-coated surface 46 with the lip 66 of the drum 60 does not produce or transmit noise, as was the case with the bearing pads used in the prior art.

As can be seen from the above, a simple, low-cost dryer drum bearing and seal assembly has been provided. A lower density, reduced cost, lower felt member 44 which functions primarily as an air seal member between the drum 60 and the support flange 34 constitutes a major portion (i.e., approximately 75%) of the ring-like felt material between the drum 60 and the flange 34. The upper felt member 42, which is formed of relatively high density material that can bear the weight of the front end of the drum 60, is carried on the upper portion of the circular flange 34. This higher density material includes, adjacent its upper surface 46, a coating or zone 50 of PTFE powder 48 which, due to sliding engagement with the lip 66 of the drum 60, produces or creates a thin layer or coating of PTFE on the lip 66 and thereby reduces the frictional interference between the bearing and seal assembly 40 and the lip 66. The upper felt member 42 performs both an air sealing function and a weight bearing function.

It should be evident that this disclosure is by way of example and that various changes may be made by adding, modifying or eliminating details without departing from the fair scope of the teaching contained in this disclosure. For example, it is disclosed that the ring of felt-like material is adhered or attached to the circular flange 34 and the PTFE powder-coated surface 46 is in engagement with the circular lip 66 of the drum 60. However, it is contemplated that this structure could be modified to have the bearing and seal assembly 40 adhered or attached to the drum's circular lip 66 such that a downwardly or inwardly directed PTFE powder-coated surface is in engagement with the circular flange 34. Moreover, if the diameter of the drum is close to the size of the access opening 22, the lip of the dryer drum 60 which engages the bearing and seal assembly 40 could be directly formed or provided on the inner periphery of the cylindrical shell of the drum 60, thereby eliminating the need for the annular front wall 64 and further reducing product costs. Therefore, it should be clear that the present invention is not to be limited to particular details of this disclosure except to the extent that the following claims are necessarily so limited.

What is claimed is:

1. A bearing and seal assembly for rotatably supporting an end of a rotatable dryer drum located within a cabinet and rotatable on a horizontal axis, said end of the drum providing a circular lip, comprising:

a circular flange supported by and fixed to the cabinet, said circular flange being coaxially nested within the circular lip;

a ring of felt-like material fixed to one of said circular flange or said circular lip, said ring of felt-like material substantially filling an annular space between said flange to establish an air seal therebetween, wherein the ring comprises an upper felt member and a lower felt member, said upper felt member being of higher density than said lower felt member, and at least a portion of said ring provides a surface which is powder-coated with a wear-resistant material, said powder-coated surface being slidably engaged by the other of said circular flange or said circular lip to rotatably support the end of the drum.

2. An assembly according to claim 1, wherein the ring of felt-like material is attached to the circular flange and the powder-coated surface is in engagement with the circular lip.

3. An assembly according to claim 1, wherein the wear-resistant material is polytetrafluoroethylene.

4. A bearing and seal assembly for rotatably supporting an end of a rotatable dryer drum located within a cabinet and rotatable on a horizontal axis, the end of the drum including a circular lip, comprising:

a circular flange supported by and operatively connected to the cabinet, said flange and said lip being coaxially nested;

a felt ring fixed to one of said circular flange or said circular lip, said felt ring substantially filling an annular space between the flange and the lip and providing an air seal therebetween, said lip, ring, and flange being generally vertically aligned during rotation of the drum, wherein said felt ring comprises first and second ring members, said first ring member being of a higher density than said second ring member and providing a weight-bearing surface which is powder-coated with a wear-resistant material, said powder-coated surface being slidably engaged by the other of said flange or lip to rotatably support the end of the drum.

5. An assembly according to claim 4, wherein the ring of felt-like material is attached to the circular flange and the powder coated surface is in engagement with the circular lip.

6. An assembly according to claim 4, wherein the wear-resistant material is polytetrafluoroethylene.

7. An assembly according to claim 6, wherein the wear-resistant material is a powder having a particle size of between 1.5 and 4 microns.

8. An assembly according to claim 7, wherein the wear-resistant material has a bulk density of between about 475 and 550 grams per liter.

9. An assembly according to claim 8, wherein the wear-resistant material is applied to the surface of the upper ring member at a rate of between about 8.7 and 10.0 grams per square yard.

10. A domestic clothes dryer, comprising:

a cabinet, said cabinet having a generally vertical front panel and side walls, said front panel providing an access opening;

an interior circular flange, said flange being supported by and fixed to the front panel and generally surrounding the access opening;

a rotatable drum located within said cabinet such that an interior of said drum is accessible via said access opening, said drum including a circular lip which coaxially nests with the circular flange, an annular space between said lip and flange being substantially filled by a ring of felt-like material to establish an air seal therebetween, wherein a portion of said ring rotatably supports the weight of said drum, said portion including a polytetrafluoroethylene-powder coated surface which is in engagement with one of said flange or said lip.

11. A domestic clothes dryer according to claim 10, wherein the ring of felt-like material is attached to the circular flange and the polytetrafluoroethylene-powder coated surface is in engagement with the circular lip.

12. A domestic clothes dryer according to claim 11, wherein the ring of felt-like material comprises an upper felt member and a lower felt member, said upper felt member being of a higher density material than said lower felt member.

13. A domestic clothes dryer according to claim 12, wherein the polytetrafluoroethylene powder has a particle size of between 1.5 and 4 microns.

14. A domestic clothes dryer according to claim 12, wherein the polytetrafluoroethylene powder has a bulk density of between about 475 and 550 grams per liter.

15. A domestic clothes dryer according to claim 12, wherein the polytetrafluoroethylene powder is applied to the surface of the upper ring member at a rate of between about 8.7 and 10.0 grams per square yard.

* * * * *